US010118733B2

(12) United States Patent
Yen

(10) Patent No.: US 10,118,733 B2
(45) Date of Patent: Nov. 6, 2018

(54) STORAGE SYSTEM

(71) Applicant: Tung-Pen Yen, New Taipei (TW)

(72) Inventor: Tung-Pen Yen, New Taipei (TW)

( * ) Notice: Subject to any disclaimer, the term of this patent is extended or adjusted under 35 U.S.C. 154(b) by 0 days.

(21) Appl. No.: 15/584,120

(22) Filed: May 2, 2017

(65) Prior Publication Data

US 2017/0320621 A1 Nov. 9, 2017

(30) Foreign Application Priority Data

May 5, 2016 (TW) ..... 105206403 U
Jan. 23, 2017 (TW) ..... 106102350 A

(51) Int. Cl.
*A47G 19/00* (2006.01)
*B65D 21/02* (2006.01)
*B65D 43/02* (2006.01)

(52) U.S. Cl.
CPC ..... *B65D 21/0201* (2013.01); *B65D 21/0209* (2013.01); *B65D 43/02* (2013.01)

(58) Field of Classification Search
CPC ..... B65D 21/02; B65D 21/00; B65D 21/0201–21/0208; B65D 43/02; B65D 21/0209–21/0231
USPC ..... 220/4.26, 4.27, 23.2–23.8, 781, 380, 220/23.83, 23.86; 206/499, 501, 206/503–513, 515–520
See application file for complete search history.

(56) References Cited

U.S. PATENT DOCUMENTS 3,539,071 A * 11/1970 Ludder ..... B65D 57/00 206/427
4,043,477 A * 8/1977 Deese ..... G09F 5/00 206/0.83
4,685,565 A * 8/1987 Sparling ..... B65D 21/0204 206/427
7,506,778 B2 * 3/2009 DaSilva ..... B65D 21/0204 220/23.4
7,549,551 B2 * 6/2009 Tyberghein ..... B65D 1/30 220/23.2
7,658,296 B2 * 2/2010 Van Handel ..... B65D 1/265 220/23.4
8,025,174 B2 * 9/2011 Martheenal ..... B65D 21/0216 206/510
8,348,077 B2 * 1/2013 Wimmer ..... B65B 17/02 220/23.4
8,678,188 B2 * 3/2014 Larsen ..... B65D 21/0231 206/503
8,770,407 B2 * 7/2014 Laupie ..... B65D 1/20 206/504

(Continued)

*Primary Examiner* — Kareen Thomas
(74) *Attorney, Agent, or Firm* — Schmeiser, Olsen & Watts, LLP

(57) ABSTRACT

A storage system includes at least two modular containers, at least two anchor members, and at least one coupler. Each of the modular containers includes a bottom wall and a surrounding wall unit with two opposite walls. Each of the two opposite walls has two lateral regions and an elongated depressed region which extends inwardly to form an elongated groove. Each of the anchor members includes a fitted end fitted slidably in a corresponding elongated groove, an enlarged head, and a neck disposed between the fitted end and the enlarged head. The coupler couples the enlarged heads of the at least two anchor members together so as to permit the at least two modular containers to be disposed in their respective orientations.

9 Claims, 9 Drawing Sheets

(56) References Cited

U.S. PATENT DOCUMENTS 8,813,960 B2 * 8/2014 Fjelland ..... B65D 21/023
206/503

* cited by examiner

STORAGE SYSTEM

CROSS-REFERENCE TO RELATED APPLICATION

This application claims priorities from Taiwanese patent application no. 105206403, filed on May 5, 2016 and Taiwanese patent application no. 106102350, filed on Jan. 23, 2017.

FIELD

The disclosure relates to a modular container, more particularly to a storage system including a plurality of modular containers.

BACKGROUND

Many plastic containers for beverages, snacks, and so on are designed for one-time use, and are not convenient for reuse.

SUMMARY

An object of the disclosure is to provide a storage system including a plurality of modular containers. The modular containers may be originally served as containers for beverages or the like, and may be cleaned and assembled based on requirements of users.

According to the disclosure, a storage system includes at least two modular containers, at least two anchor members, and at least one coupler. Each of the modular containers includes a bottom wall and a surrounding wall unit. The surrounding wall unit extends upwardly from a periphery of the bottom wall to terminate at an upper edge, and defines, together with the bottom wall, an accommodation space. The surrounding wall unit has two opposite walls each having two lateral regions and an elongated depressed region. The elongated depressed region is disposed between the lateral regions, and extends inwardly to form an elongated groove having a groove bottom surface and two opposite sidewall surfaces. Each of the two opposite sidewall surfaces extends outwardly to terminate at a juncture area which joins a corresponding one of the lateral regions. The juncture areas of the two opposite sidewall surfaces are spaced apart from each other to define a slot therebetween. The at least two anchor members are mounted to the at least two modular containers, respectively. Each of the anchor members includes a fitted end, an enlarged head, and a neck. The fitted end is configured to be slidably fitted in a corresponding elongated groove of a corresponding one of the modular containers. The enlarged head has an outer surface and an inner abutment surface which is configured to be brought into frictional engagement relative to the two juncture areas of the corresponding elongated groove. The neck is disposed between the fitted end and the enlarged head, and is moveable in the slot of the corresponding elongated groove between a proximate position and a distal position. The at least one coupler is configured to couple the enlarged heads of the two anchor members together so as to keep the necks of the two anchor members at selected ones of the proximate and distal positions to thereby permit the at least two modular containers to be disposed in their respective orientations.

BRIEF DESCRIPTION OF THE DRAWINGS

Other features and advantages of the disclosure will become apparent in the following detailed description of the embodiments with reference to the accompanying drawings, in which.

DETAILED DESCRIPTION

Figure 1:
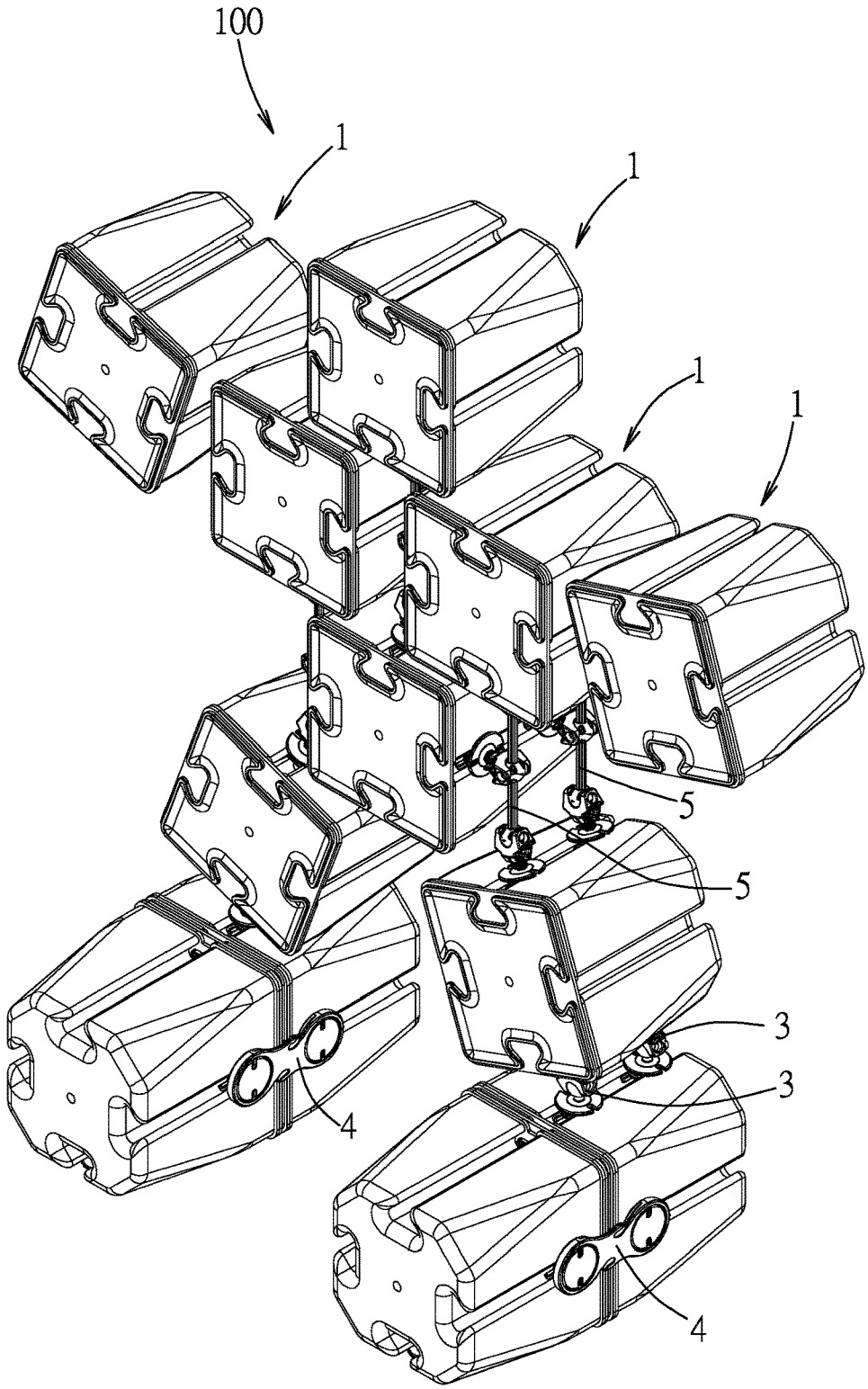
FIG. 1 is a perspective view of an assembly of a plurality of storage systems according to the disclosure.

Before the disclosure is described in greater detail, it should be noted that where considered appropriate, reference numerals have been repeated among the figures to indicate corresponding or analogous elements, which may optionally have similar characteristics.

Figure 8:
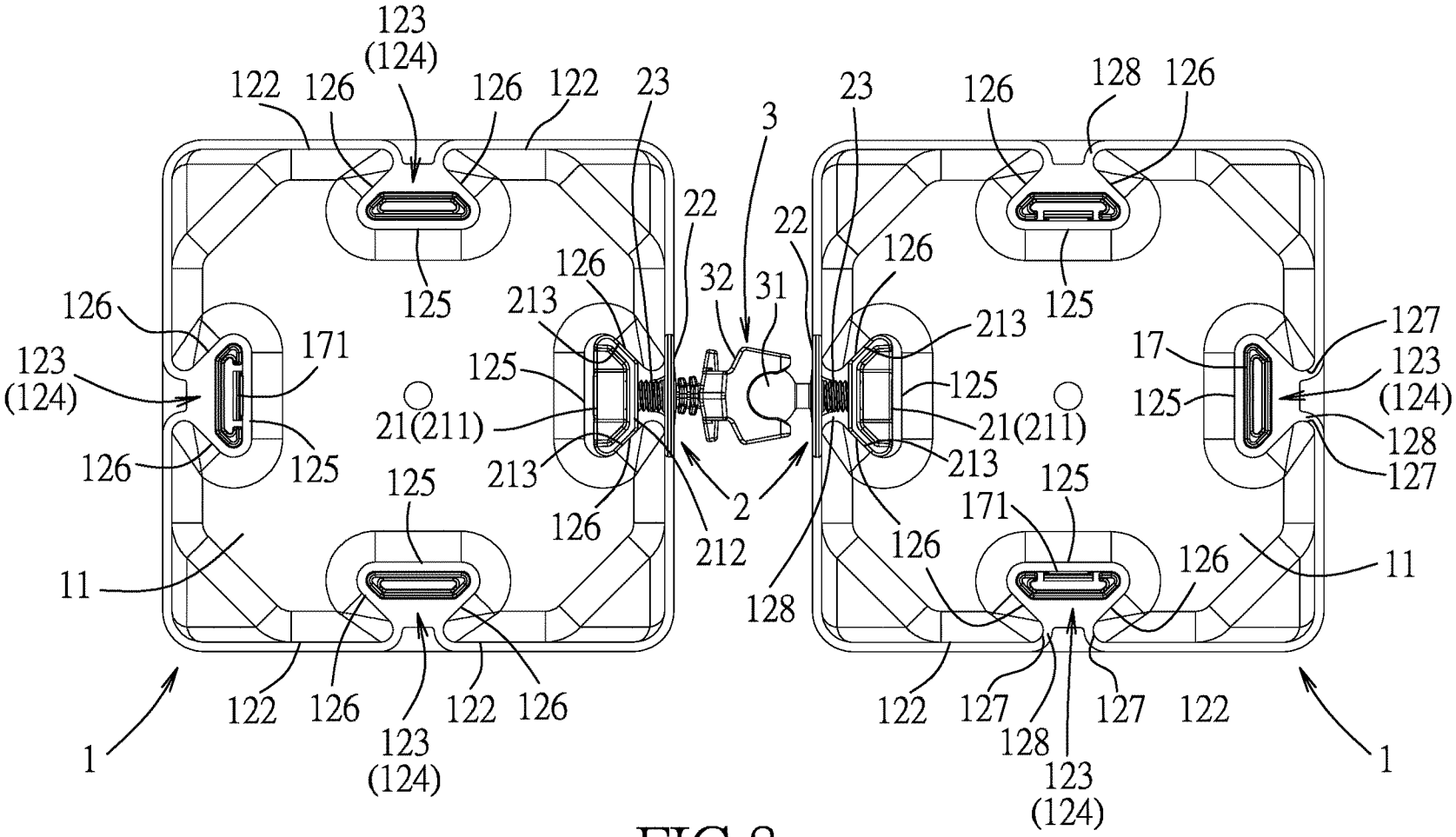
FIG. 8 is a bottom view of the storage system according to the first embodiment of the disclosure.

With reference to FIG. 8, a storage system according to a first embodiment of the disclosure is shown to include at least two modular containers 1, at least two anchor members 2 and at least one coupler 3.

Figure 2:
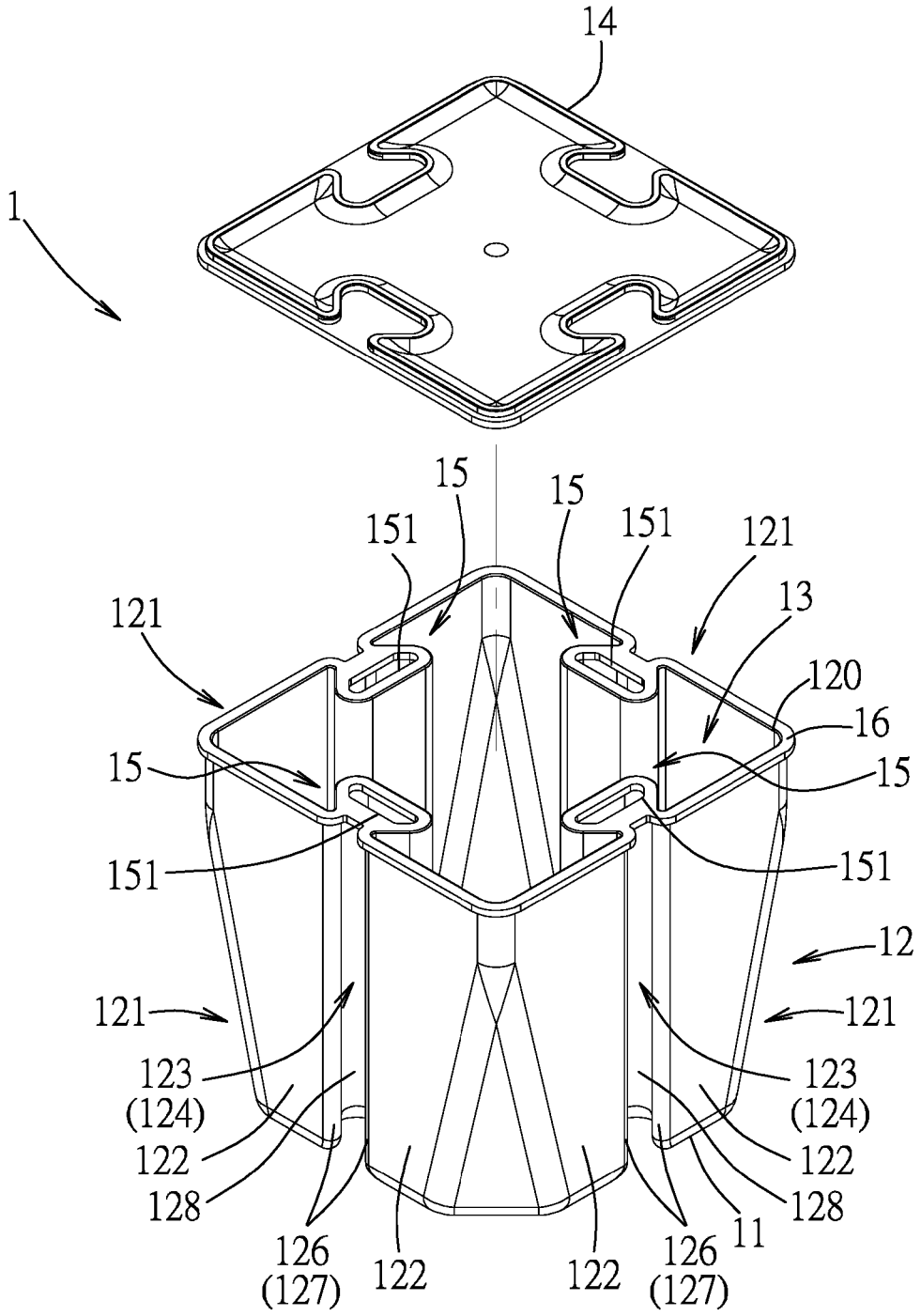
FIG. 2 is an exploded perspective view of a modular container of a storage system according to the disclosure.
Figure 3:
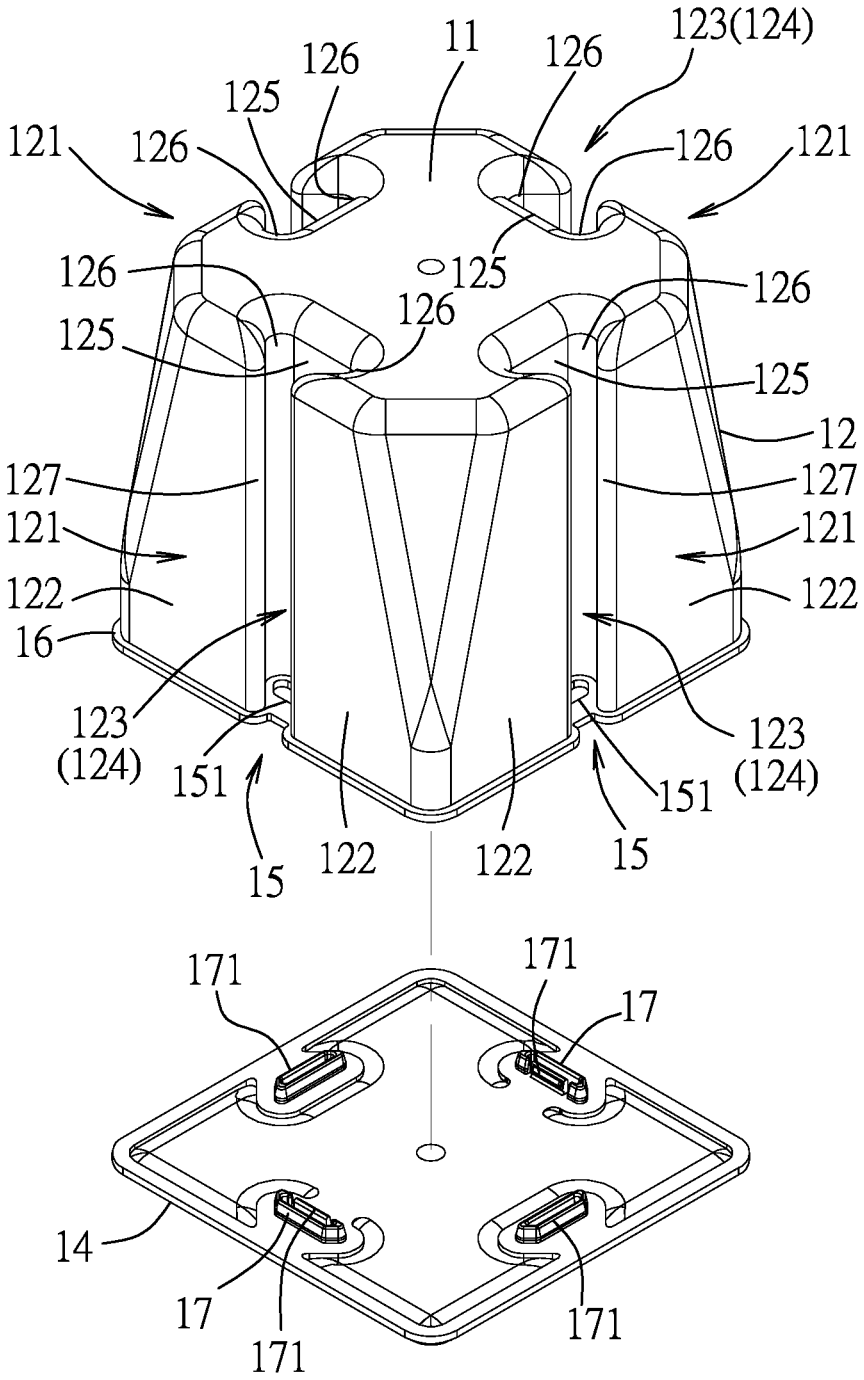
FIG. 3 is similar to FIG. 2 but illustrating the modular container viewed from the bottom.

As shown in FIGS. 2 and 3, each of the modular containers 1 includes a bottom wall 11 and a surrounding wall unit 12. The surrounding wall unit 12 extends upwardly from a periphery of the bottom wall 11 to terminate at an upper edge 120, and defines, together with the bottom wall 11, an accommodation space 13. In this embodiment, the surrounding wall unit 12 has four walls 121. In other embodiments, the number of the walls 121 may be varied based on design preference.

Each of the walls 121 has two lateral regions 122, and an elongated depressed region 123 disposed between the lateral regions 122. The elongated depressed region 123 extends inwardly to form an elongated groove 124 having a groove bottom surface 125 and two opposite sidewall surfaces 126. The two opposite sidewall surfaces 126 diverge toward the groove bottom 125. Each of the two opposite sidewall surfaces 126 extends outwardly to terminate at a juncture area 127 which joins a corresponding one of the lateral regions 122. The juncture areas 127 of the two opposite sidewall surfaces 126 are spaced apart from each other to define a slot 128 therebetween.

Each of the modular containers 1 may further includes a cover plate 14, a plurality of spacer pieces 15 in number corresponding to the number of the walls 121, a looped strip 16, and a plurality of plug members 17 in number corresponding to the number of the spacer pieces 15.

Each of the spacer pieces 15 is fittingly inserted the elongated groove 124 of a corresponding one of the walls 121 adjacent to the upper edge 120 so as to keep the slot 128 of the corresponding one of the walls 121. Each of the spacer pieces 15 has a socket hole 151.

The looped strip 16 is disposed on the upper edge 120 and interconnects the spacer pieces 15. In this embodiment, the spacer pieces 15 and the looped strip 16 are formed into one piece.

The cover plate 14 is configured to be detachably secured on the looped strip 16.

Figure 4:
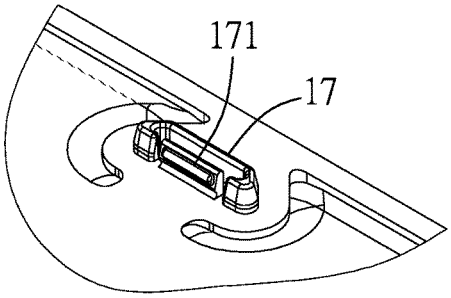
FIG. 4 is an enlarged view of a plug member of the modular container.

The plug members 17 are formed on an inward surface of the cover plate 14, and are configured to be respectively fitted into the socket holes 151 of the spacer pieces 15 so as to permit the cover plate 14 to be firmly secured on the looped strip 16. In this embodiment, as shown in FIGS. 3 and 4, some of the plug members 17 may have an elastic segment 171 configured to be snap-fitted in the respective socket hole 151.

In addition, each of the modular containers 1 may include a film (not shown) configured to seal the accommodation space 13.

Figure 5:
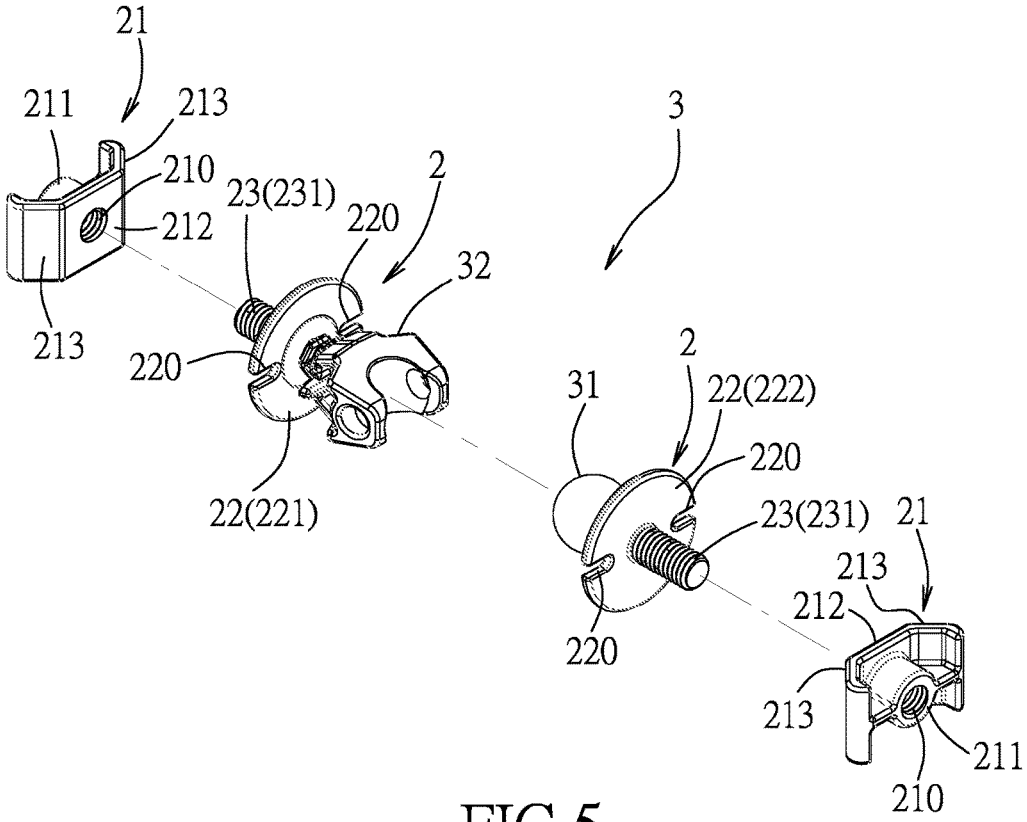
FIG. 5 is an exploded perspective view illustrating a coupler and two anchor members used in a storage system according to a first embodiment of the disclosure.

The at least two anchor members 2 are mounted to the at least two modular containers 1, respectively. As shown in FIG. 5, each of the anchor members 2 includes a fitted end 21, an enlarged head 22, and a neck 23.

Figure 7:
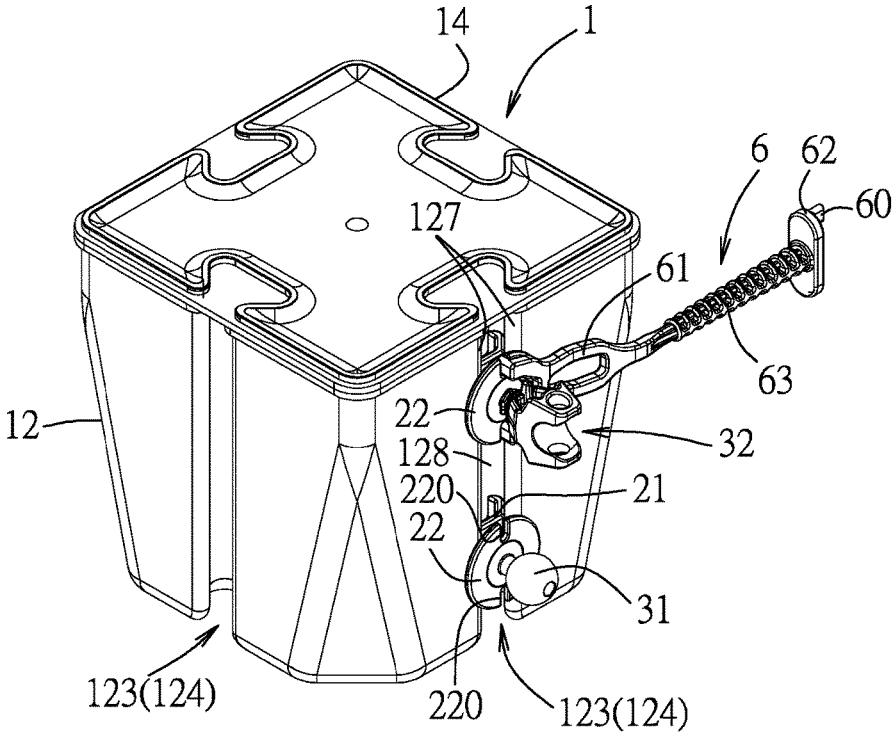
FIG. 7 is a perspective view illustrating the tool engaged on an enlarged head of an anchor member.

The fitted end 21 is configured to be slidably fitted in a corresponding elongated groove 124 of a corresponding one of the modular containers 1 (see also FIGS. 7 and 8).

In this embodiment, the fitted end 21 has a nut body 211, a flange 212, and two flange extensions 213. The nut body 211 has a female threaded hole 210 configured to be accessible through the slot 128 of the corresponding elongated groove 124. The flange 212 extends outwardly and radially from an outer end of the nut body 211. The two flange extensions 213 extend oppositely from the flange 212, and are configured to be brought into frictional engagement with the two opposite sidewall surfaces 126 of the corresponding elongated groove 124, respectively.

The enlarged head 22 has an outer surface 221 and an inner abutment surface 222. The inner abutment surface 222 is configured to be brought into frictional engagement relative to the two juncture areas 127 of the corresponding elongated groove 124.

The neck 23 is disposed between the fitted end 21 and the enlarged head 22, and is moveable in the slot 128 of the corresponding elongated groove 124 between a proximate position and a distal position.

In this embodiment, the neck 23 has a male threaded region 231 which is configured to be brought into threaded engagement with the female threaded hole 210 so as to permit the flange extensions 213 to abut against the two opposite sidewall surfaces 126 of the corresponding elongated groove 124, respectively.

Figure 6:
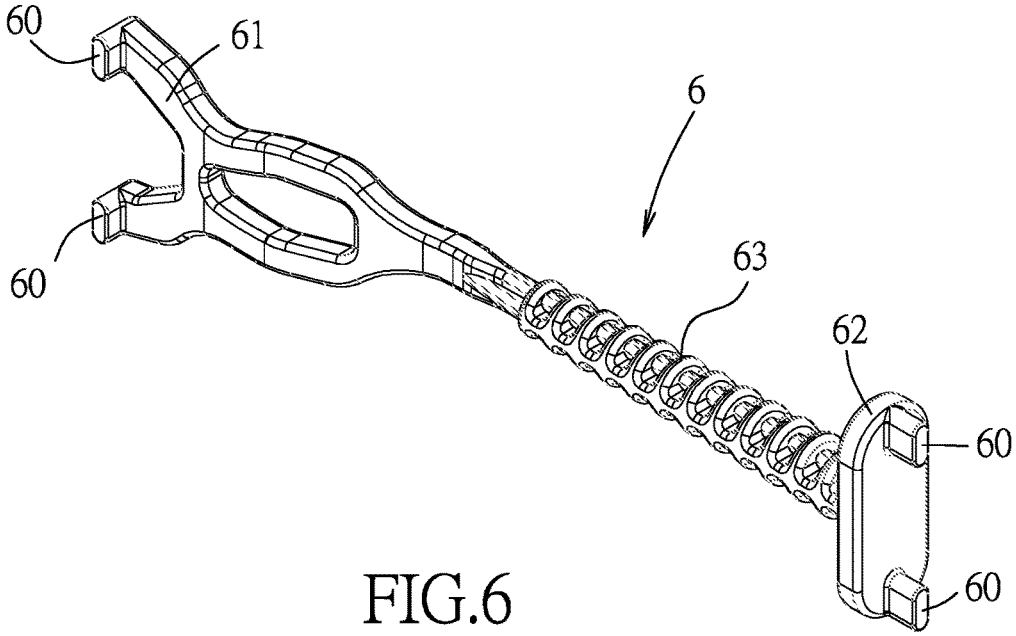
FIG. 6 is a perspective view of a tool for turning a neck of each anchor member.

In this embodiment, the enlarged head 22 is formed with two radially opposite slots 220 for ease of manual operation to turn the neck 23 to screw in or out of the nut body 211. As shown in FIGS. 6 and 7, a tool 6 may be used for turning the enlarged head 22 and the neck 23. The tool 6 has a first end segment 61, a second end segment 62, and a holder body 63 disposed between the first and second end segments 61, 62. Each of the first and second end segments 61, 62 has a pair of drive teeth 60 configured to be respectively inserted in the two radially opposite slots 220 so as to turn the neck 23 to screw the neck 23 in or out of the nut body 211.

The coupler 3 is configured to couple the enlarged heads 22 of the two anchor members 2 together so as to keep the necks 23 of the two anchor members 2 at selected ones of the proximate and distal position to thereby permit the two modular containers 1 to be disposed in their respective orientations.

In this embodiment, as shown in FIG. 5, the coupler 3 includes a joint ball 31 and a ball socket 32.

The joint ball 31 is secured on the outer surface 221 of the enlarged head 22 of one of the two anchor members 2.

The ball socket 32 is secured on the outer surface 221 of the enlarged head 22 of the other one of the two anchor members 2, and is configured to receive the joint ball 31 such that the joint ball 31 and the ball socket 32 constitute a universal ball and socket joint.

Figure 9:
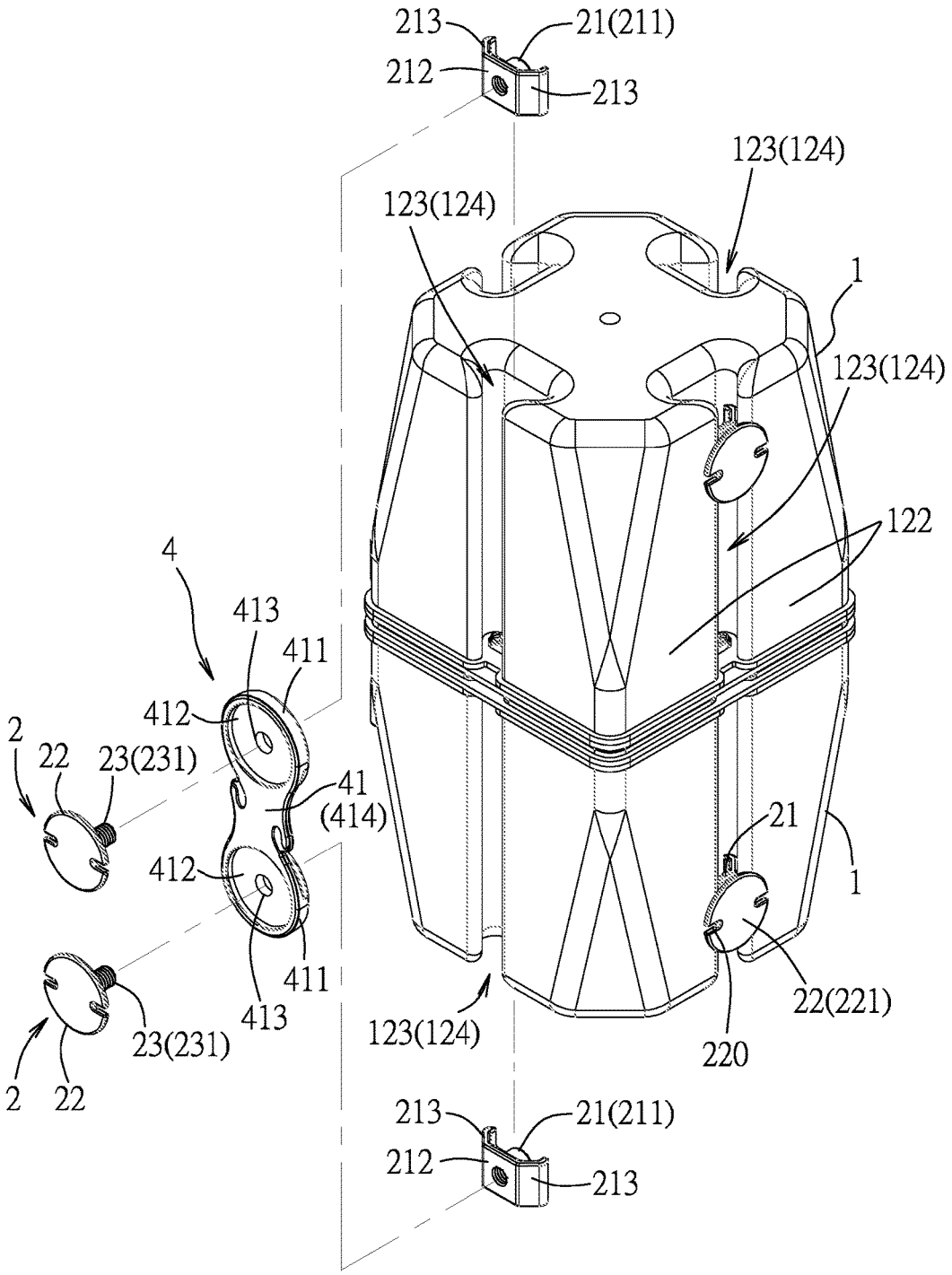
FIG. 9 is a partial exploded perspective view of a storage system according to a second embodiment of the disclosure.

FIG. 9 illustrates a storage system according to a second embodiment of the disclosure. The storage system includes at least two modular containers 1, at least two anchor members 2, and at least one coupler 4. The modular containers 1 and the anchor members 2 are similar to those disclosed in the first embodiment.

The coupler 4 includes an elastomeric locking piece 41 having two end segments 411 and a mid segment 414.

Each of the two end segments 411 is formed with a recess 412 configured to permit the enlarged head 22 of a corresponding one of the anchor members 2 to be fitted therein. Each of the two end segments 411 has a through hole 413 formed in the recess 412 so as to permit extension of the neck 23 of a corresponding one of the anchor members 2.

The mid segment 414 is disposed between the two end segments 411 and is configured to acquire a biasing force in response to stretching of the elastomeric locking piece 41. When the upper edges 120 of the two modular containers 1 are disposed to confront each other, the upper edges 120 are biased by the biasing force toward each other.

Figure 10:
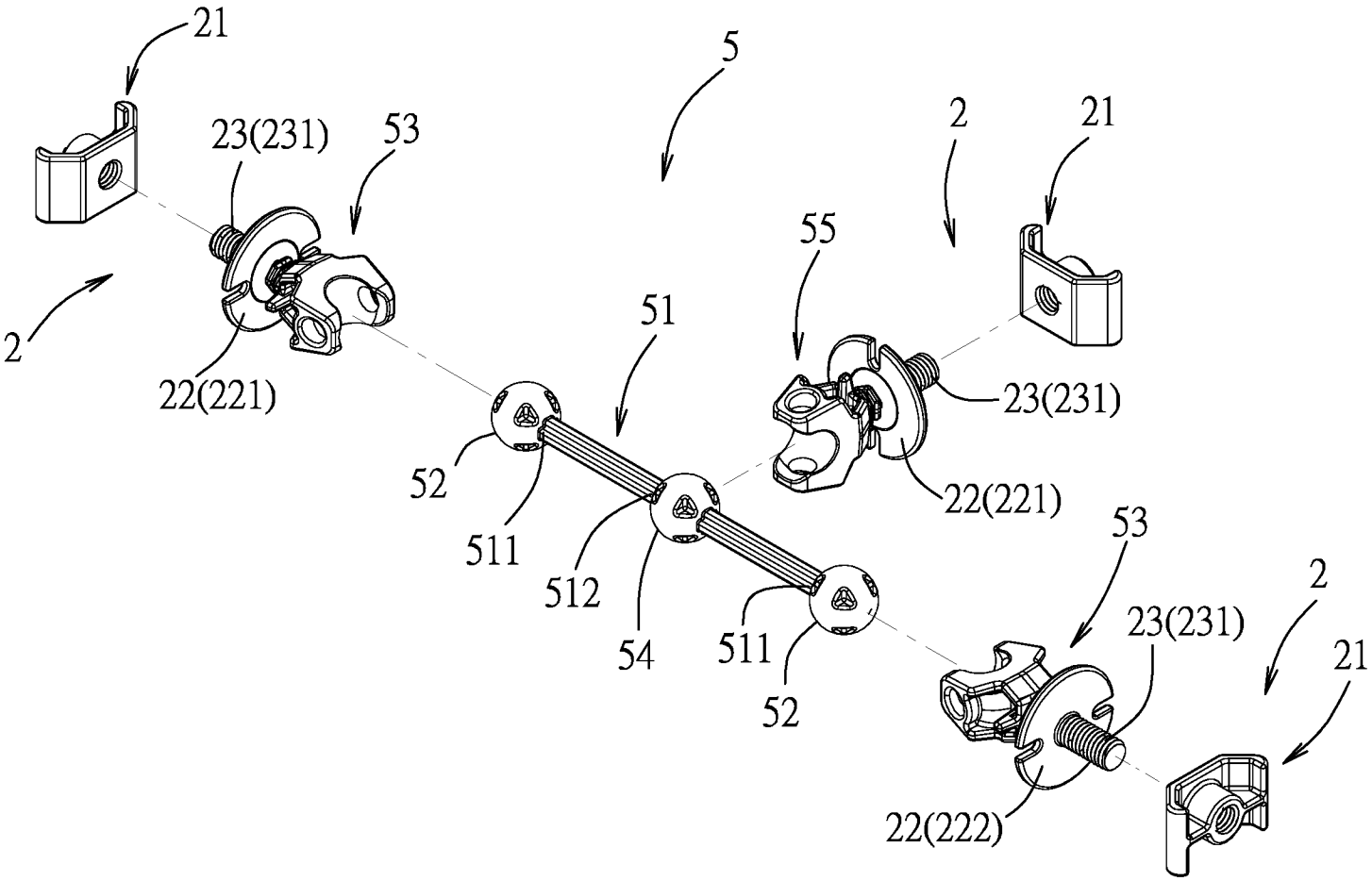
FIG. 10 is an exploded perspective view illustrating a coupler and three anchor members used in a storage system according to a third embodiment of the disclosure.
Figure 11:
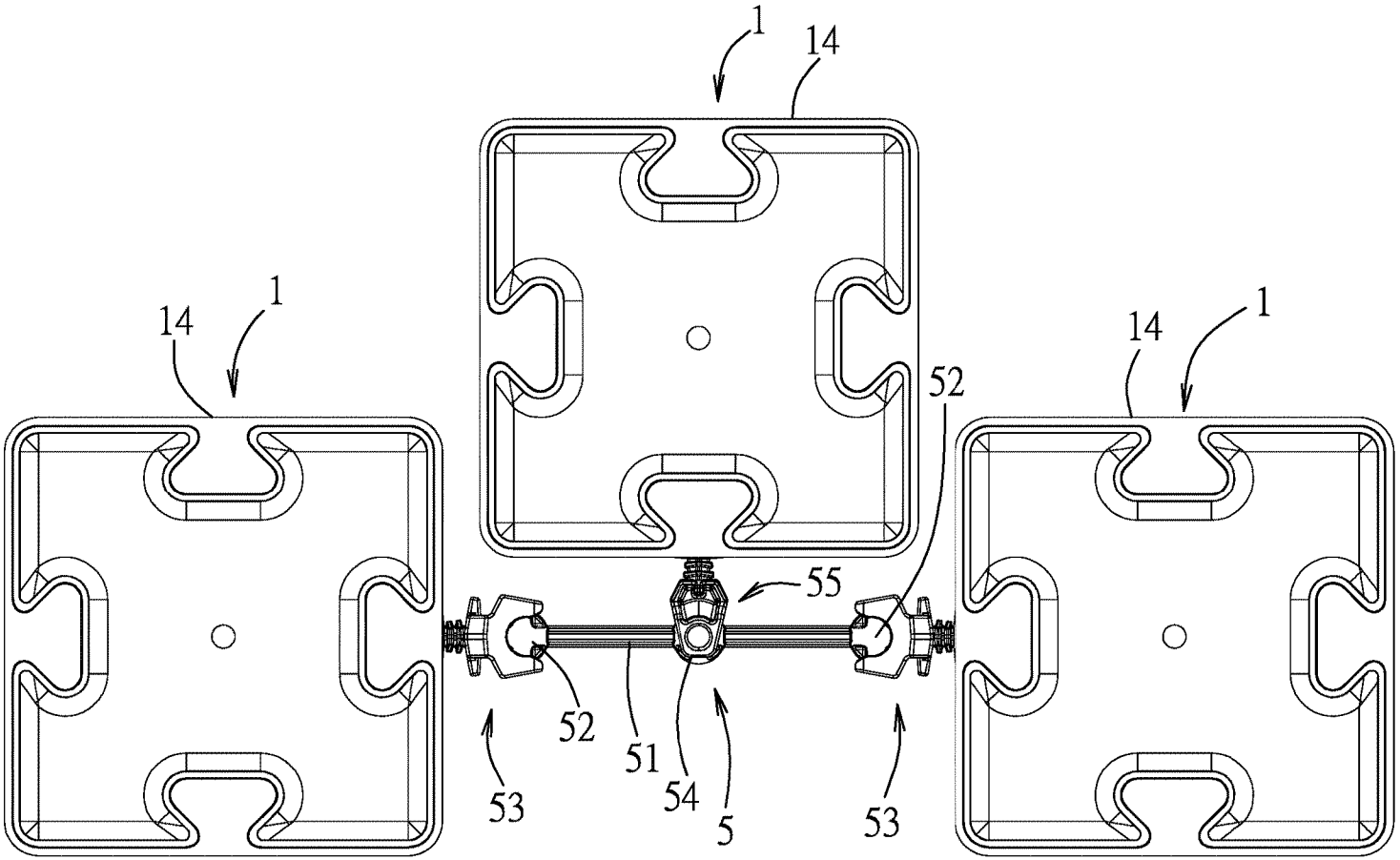
FIG. 11 is a top view of the storage system according to the third embodiment of the disclosure.

FIGS. 10 and 11 illustrate a storage system according to a third embodiment of the disclosure. The storage system includes at least two modular containers 1, at least two anchor members 2, and at least one coupler 5. The modular containers 1 and the anchor members 2 are similar to those disclosed in the first embodiment.

The coupler 5 includes a connecting rod 51, two joint balls 52, and two ball sockets 53.

The connecting rod 51 has two opposite ends 511 and an intermediate segment 512 between the two opposite ends 511.

The two joint balls 52 are secured on the two opposite ends 511 of the connecting rod 51, respectively.

The two ball sockets 53 are secured on the outer surfaces 221 of the enlarged heads 22 of the two anchor members 2, respectively, and are configured to receive the joint balls 52, respectively, such that each of the joint balls 52 and a corresponding one of the ball sockets 53 constitute a universal ball and socket joint.

In the third embodiment, the storage system includes at least three of the modular containers 1 and at least three of the anchor members 2, and the coupler 5 further includes an additional joint ball 54 and an additional ball socket 55.

The additional joint ball 54 is secured on the intermediate segment 512 of the connecting rod 51.

The additional ball socket 55 is secured on the outer surface 221 of the enlarged head 22 of the remaining one of the anchor members 2, and is configured to receive the additional joint ball 54 such that the additional joint ball 54 and the additional ball socket 55 constitute a universal ball and socket joint.

The modular containers 1 originally served as containers for beverages or the like may be reused. Users may collect the modular containers 1 and assemble the modular containers 1 using the couplers 3, 4, 5 into a desirable design, as shown in FIG. 1.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A storage system comprising:

at least two modular containers, each including a bottom wall, and a surrounding wall unit which extends upwardly from a periphery of said bottom wall to terminate at an upper edge, and which defines, together with said bottom wall, an accommodation space, said surrounding wall unit having two opposite walls each having two lateral regions, and an elongated depressed region which is disposed between said lateral regions, and which extends inwardly to form an elongated groove having a groove bottom surface and two opposite sidewall surfaces, each of said two opposite sidewall surfaces extending outwardly to terminate at a juncture area which joins a corresponding one of said lateral regions, said juncture areas of said two opposite sidewall surfaces being spaced apart from each other to define a slot therebetween;

at least two anchor members which are mounted to said at least two modular containers, respectively, each of said anchor members including a fitted end configured to be slidably fitted in a corresponding elongated groove of a corresponding one of said modular containers, an enlarged head having an outer surface and an inner abutment surface which is configured to be brought into frictional engagement relative to said two juncture areas of said corresponding elongated groove, and a neck which is disposed between said fitted end and said enlarged head, and which is moveable in said slot of said corresponding elongated groove between a proximate position and a distal position; and at least one coupler configured to couple said enlarged heads of said two anchor members together so as to keep said necks of said two anchor members at selected ones of the proximate and distal positions to thereby permit said at least two modular containers to be disposed in their respective orientations.

2. The storage system according to claim 1, wherein said two opposite sidewall surfaces diverge toward said groove bottom;

said fitted end has a nut body having a female threaded hole configured to be accessible through said slot of said corresponding elongated groove, a flange extending outwardly and radially from an outer end of said nut body, and two flange extensions extending oppositely from said flange, and configured to be brought into frictional engagement with said two opposite sidewall surfaces of said corresponding elongated groove, respectively; and said neck has a male threaded region which is configured to be brought into threaded engagement with said female threaded hole so as to permit said flange extensions to abut against said two opposite sidewall surfaces of said corresponding elongated groove, respectively.

3. The storage system according to claim 1, wherein said coupler includes a joint ball secured on said outer surface of said enlarged head of one of said two anchor members, a ball socket which is secured on said outer surface of said enlarged head of the other one of said two anchor members, and which is configured to receive said joint ball such that said joint ball and said ball socket constitute a universal ball and socket joint.

4. The storage system according to claim 1, wherein said coupler includes an elastomeric locking piece having two end segments, each of which is formed with a recess configured to permit said enlarged head of a corresponding one of said anchor members to be fitted therein, and each of which has a through hole formed in said recess so as to permit extension of said neck of a corresponding one of said anchor members, and a mid segment which is disposed between said two end segments and which is configured to acquire a biasing force in response to stretching of said elastomeric locking piece, such that when said upper edges of said two modular containers are disposed to confront each other, said upper edges are biased by the biasing force toward each other.

5. The storage system according to claim 1, wherein said coupler includes a connecting rod having two opposite ends and an intermediate segment between said two opposite ends, two joint balls secured on said two opposite ends of said connecting rod, respectively, and two ball sockets which are secured on said outer surfaces of said enlarged heads of said two anchor members, respectively, and which are configured to receive said joint balls, respectively, such that each of said joint balls and a corresponding one of said ball sockets constitute a universal ball and socket joint.

6. The storage system according to claim 5, which comprises three of said modular containers and three of said anchor members, wherein said coupler further includes an additional joint ball secured on said intermediate segment of said connecting rod, an additional ball socket which is secured on said outer surface of said enlarged head of the remaining one of said anchor members, and which is configured to receive said additional joint ball such that said additional joint ball and said additional ball socket constitute a universal ball and socket joint.

7. The storage system according to claim 1, wherein each of said modular containers further includes at least two spacer pieces each of which is fittingly inserted in said elongated groove of a corresponding one of said two opposite walls adjacent to said upper edge, so as to keep said slot of said corresponding one of said two opposite walls.

8. The storage system according to claim 7, wherein each of said spacer pieces has a socket hole, and each of said modular containers further includes a looped strip disposed on said upper edges and interconnecting said spacer pieces, a cover plate configured to be detachably secured on said looped strip, and at least two plug members which are formed on an inward surface of said cover plate, and which are configured to be respectively fitted into said socket holes of said spacer pieces so as to permit said cover plate to be firmly secured on said looped strip.

9. The storage system according to claim 2, wherein said enlarged head is formed with two radially opposite slots for ease of manual operation to turn said neck to screw in or out of said nut body.

* * * * *